US005844537A

United States Patent [19]

Bonnett et al.

[11] Patent Number: 5,844,537

[45] Date of Patent: Dec. 1, 1998

[54] LIQUID CRYSTAL DISPLAY, DATA SIGNAL GENERATOR, AND METHOD OF ADDRESSING A LIQUID CRYSTAL DISPLAY

[75] Inventors: Paul Bonnett; Akira Tagawa; Michael John Towler, all of Oxford, United Kingdom

[73] Assignee: Sharp Kabushiki Kaisha, Osaka, Japan

[21] Appl. No.: 550,537

[22] Filed: Oct. 30, 1995

[30] Foreign Application Priority Data

Nov. 1, 1994 [GB] United Kingdom ..... 9421970

[51] Int. Cl.[6] ..... G09G 3/36

[52] U.S. Cl. ..... 345/97; 345/94

[58] Field of Search ..... 345/97, 94, 96

[56] References Cited

U.S. PATENT DOCUMENTS

| | | | |
|---|---|---|---|
| 4,712,877 | 12/1987 | Okada et al. | 349/85 |
| 5,018,841 | 5/1991 | Mouri et al. | 345/97 |
| 5,177,475 | 1/1993 | Stephany et al. | 345/97 |
| 5,285,214 | 2/1994 | Bowry | 345/97 |

FOREIGN PATENT DOCUMENTS

| | | |
|---|---|---|
| 0603848 | 6/1994 | European Pat. Off. . |
| 2225473 | 5/1990 | United Kingdom . |
| 9202925 | 2/1992 | WIPO . |
| 9418665 | 8/1994 | WIPO . |

OTHER PUBLICATIONS

Search Report for U.K. Appl. 9421970.6, mailed Feb. 16, 1995.

Surguy et al, *Ferroelectrics*, 1991, vol. 122, pp. 63–79, "The Joers/Alvey Ferroelectric Multiplexing Scheme".

Hughes et al, *Liquid Crystals*, 1993, vol. 13, No. 4, pp. 597–601, "A New Set of High Speed Matrix Addressing Schemes for . . . ".

European Search Report for Application EP 95307751.8; mailed Nov. 28, 1996.

Sugihara et al., AES Journal of the Audio Engineering Society, 37 (1989) Oct., No. 10, "Ferroelectric Liquid Crystal Shutters for Half–tone Recording", pp. 123–130.

Jones et al, Displays, vol. 14, No. 2, 1993, "Fast, High Contrast Ferroelectric Liquid Crystal Displays and the Role of Dielectric Biaxiality", pp. 86–93.

*Primary Examiner*—Matthew Luu

[57] ABSTRACT

A ferroelectric liquid crystal display contains data electrodes connected to a data signal generator and strobe electrodes connected to a strobe signal generator. The strobe signal generator supplies strobe signals Vs1 to Vs4 in sequence to the strobe electrodes and the data signal generator supplies data signals Vd1 to Vd4 simultaneously and in synchronism with the strobe signals so as to refresh sequentially the rows of pixels formed at the intersections of the data electrodes and the strobe electrodes. Each data signal is selected from a plurality having the same polarity behaviour with respect to time, the same RMS voltage, and no net DC component.

14 Claims, 8 Drawing Sheets

LIQUID CRYSTAL DISPLAY, DATA SIGNAL GENERATOR, AND METHOD OF ADDRESSING A LIQUID CRYSTAL DISPLAY

The present invention relates to a liquid crystal display, a data signal generator, and a method of addressing a liquid crystal display.

Ferroelectric liquid crystal displays (FLCDs) are prime contenders for use in high resolution display applications including high definition television (HDTV) panels. However, such applications require that the display be capable of producing a large number of grey levels, for instance 256 grey levels for HDTV. Although digital methods are known for producing grey levels in FLCDs, involving spatial and temporal multiplexing or "dither" techniques, it has not been possible to achieve more than 64 grey levels in practical panels.

It is possible to produce grey level, using analogue or multi-threshold (MT) methods. MT methods make use of a number of discrete threshold levels within a picture element (pixel) whereas analogue methods use an essentially continuous threshold variation over a pixel. For instance, by providing four grey levels by analogue or MT methods in combination with two "bits" of spatial dither and two bits of temporal dither, 256 grey levels can be produced in practical FLCDs. The problem is then to "address" the different analogue or MT levels.

Displays of this type comprise row and column electrodes extending on opposite sides of the liquid crystal. The intersections of these electrodes define liquid crystal pixels. Strobe signals are applied sequentially to, for instance, the row electrodes whereas data signals are applied simultaneously to the column electrodes and in synchronism with the strobe signals. Thus, the data to be displayed are written into the display a row at a time.

During the period in which a given row is addressed, a finite strobe voltage is applied to that row and DC balanced data pulses are applied to the columns. In the simplest case, two data types are used which in combination with the strobe voltage yield either a switching or non-switching resultant. These data pulses are typically the negatives of each other. If analogue or MT grey levels are used within a pixel, then more than two data types are required.

Before and after the addressing period of each row, the pixels within it are subject to arbitrary data pulses and these act to modify the $\tau$-V switching characteristics of those pixels. If the addressing scheme being used has a narrow operating window, then for some pixel patterns the discrimination between switching and non-switching pulses can be reduced or even lost.

The $\tau$-V switching characteristic generally has a finite width which is made up of two components. The first is a basic switch width, dependent on material and device characteristics. The second component, which typically doubles the basic switch width, is caused by pixel pattern dependence. It is desirable to remove or at least reduce this component and reduce the switch width towards its basic width.

According to a first aspect of the invention, there is provided a liquid crystal display as defined in the appended claim 1.

According to a second aspect of the invention, there is provided a data signal generator as defined in the appended claim 10.

According to a third aspect of the invention there is provided a method as defined in the appended claim 14.

Preferred embodiments of the invention are defined in the other appended claims.

It is thus possible to provide a technique which reduces or overcomes the problem of pixel pattern dependence within a liquid crystal display. This technique may be used with black and white displays where pixel patterning is a problem. The technique is particularly useful for displays having analogue or MT grey level capability and reduces or overcomes the problem of pixel patterning. This represents a significant advance in the use of FLCDs for large direct view high resolution display applications, particularly where fast addressing of analogue grey levels is required.

The invention will be further described, by way of example, with reference to the accompanying drawings, in which:

FIG. 1 shows a liquid crystal display comprising a 4×4 array of pixels. In practice, a display would comprise many more pixels arranged as a square or rectangular matrix but a 4×4 array has been shown for the sake of simplicity of description.

Figure 1:
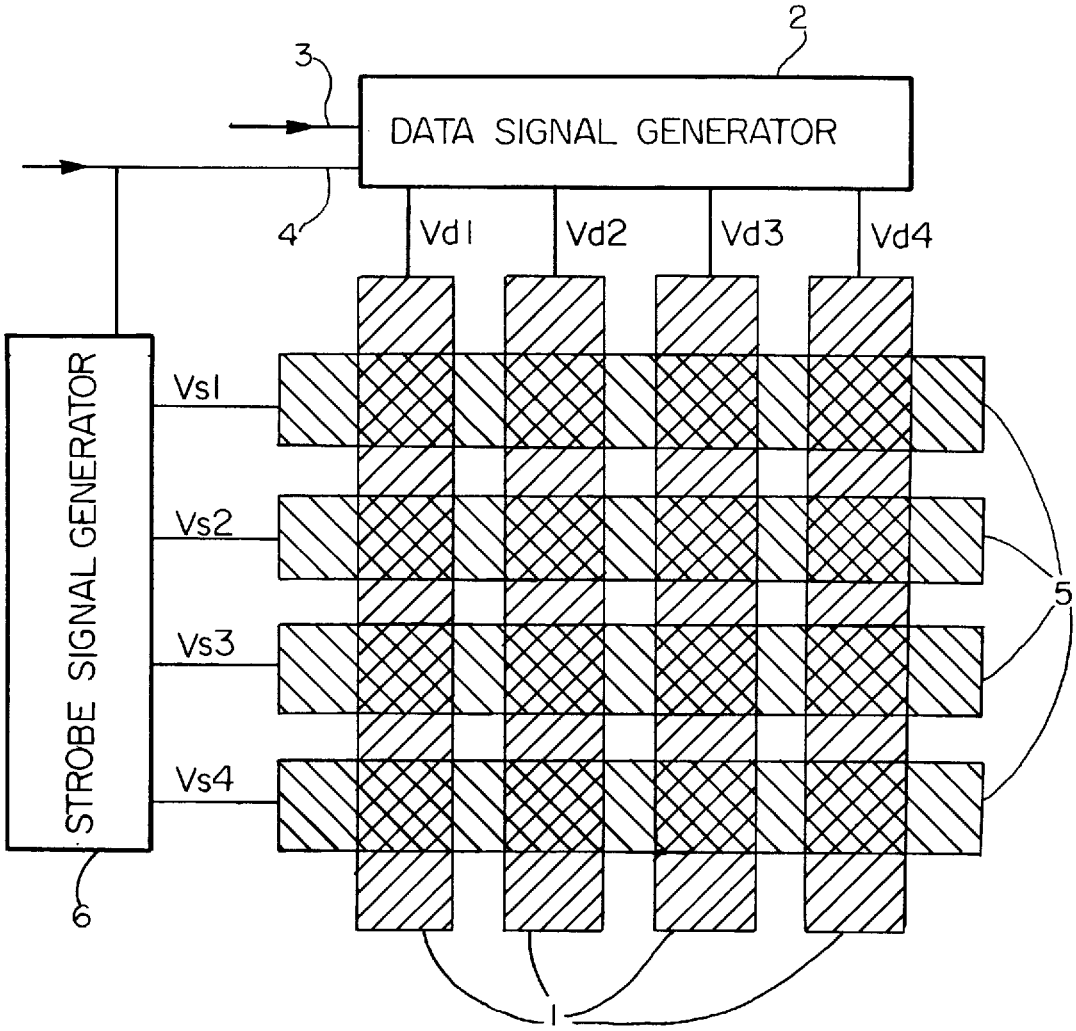
FIG. 1 is a schematic diagram of a liquid crystal display to which the invention may be applied.

The display comprises four column electrodes 1 connected to respective outputs of a data signal generator 2 so as to receive data signals Vd1 to Vd4. The generator 2 has a data input 3 for receiving data to be displayed, for instance one row at a time. The generator 2 has a synchronising input 4 for receiving timing signals so as to control the timing of the supply of the data signals Vd1 to Vd4 to the column or data electrodes 1.

The display further comprises four row electrodes 5 connected to respective outputs of a strobe signal generator 6 so as to receive respective strobe signals Vs1 to Vs4. The generator 6 has a synchronising input which is also connected to receive timing signals for controlling the timing of supply of the strobe signals Vs1 to Vs4 to the row or strobe electrodes 5.

The display further comprises a liquid crystal arranged as a layer between the data electrodes 1 and the strobe electrodes 5. The liquid crystal comprises a ferroelectric liquid crystal of smectic type which is bistable. The liquid crystal may be of the type having a minimum in its $\tau$-V characteristic. A suitable material comprises SCE8 available from Merck (U.K.) Ltd. The thickness of the liquid crystal layer is approximately 2 micrometers with parallel rubbed alignment layers providing approximately 5° of surface tilt. The intersections between the data and strobe electrodes define individual pixels which are addressable independently of each other.

Figure 2:
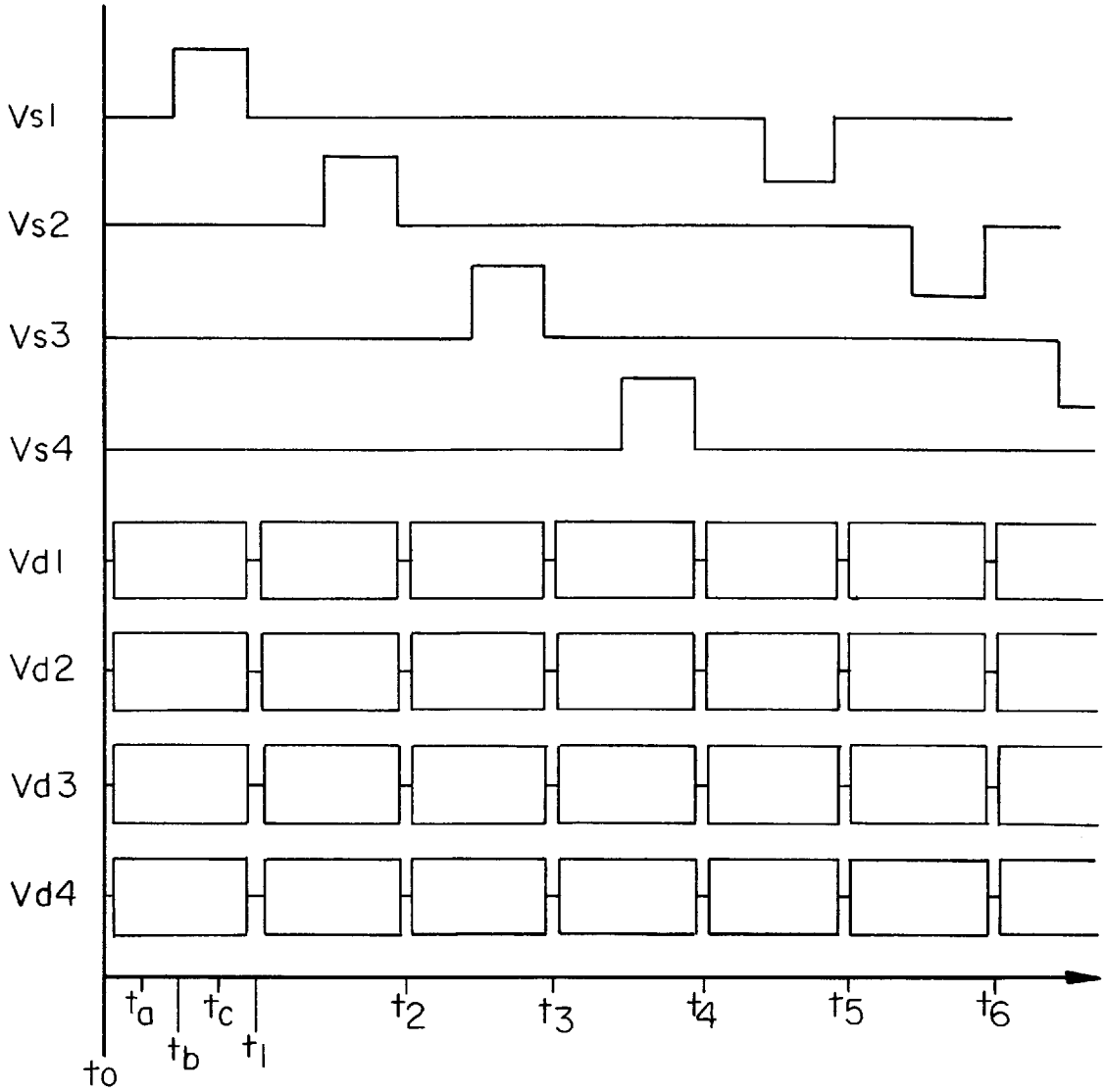
FIG. 2 is a timing diagram illustrating strobe and data signals for a display of the type shown in FIG. 1.

FIG. 2 is a diagram illustrating the timing and waveforms of the data and strobe signals in accordance with an existing technique of operating a display of the type shown in FIG. 1. The strobe signals Vs1 to Vs4 are supplied in sequence to the row electrodes 5 with each strobe signal occupying a respective time slot. Thus, the strobe signal Vs1 is supplied during the time slot $t_0$ to $t_1$, the strobe Vs2 is supplied during the time slot $t_1$ to $t_2$, and so on with the sequence repeating for consecutive groups of four time slots. Further, each time slot is divided into four sub-slots, for instance as illustrated for the first slot with the sub-slots starting at $t_0$, $t_a$, $t_b$, and $t_c$. During its active time slot, for instance the first time slot for the strobe signal Vs1, the strobe signal has zero level for the first two sub-slots and a predetermined level Vs for the third and fourth time sub-slots. In order to prevent DC imbalance, the polarities of the strobe signals may be reversed after each complete frame refresh of the display.

The data signals Vd1 to Vd4 are supplied simultaneously with each other and in synchronism with the strobe signals, as shown In FIG. 2. For the purpose of illustration, each data signal is illustrated by a rectangular box in FIG. 2. Also, gaps are shown between consecutive data signals for the purpose of clarity although, in practice, consecutive data signals are contiguous.

Figure 3:
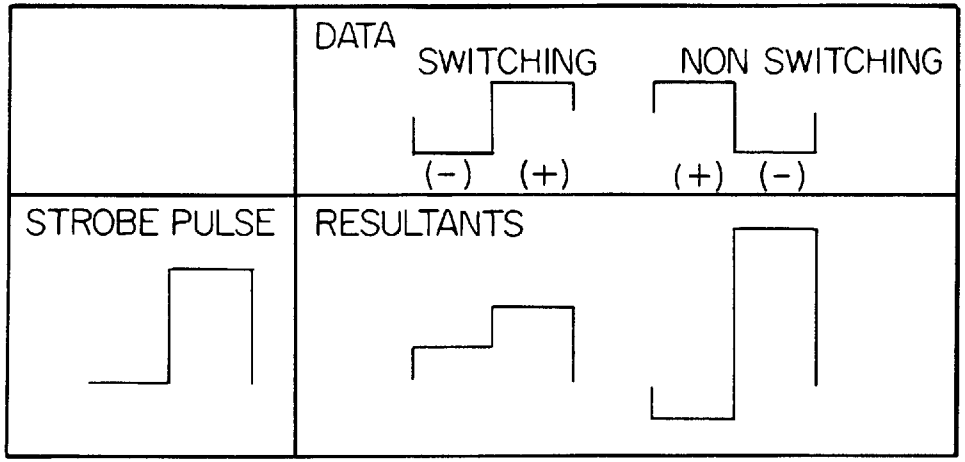
FIG. 3 illustrates strobe and data signals of a known binary (black/white) addressing scheme.

FIG. 3 shows data and strobe waveforms of a known addressing scheme, together with the resultant waveforms appearing across the pixels. Each of the two data pulses is DC balanced i.e. has no net direct component. Further, the RMS voltages of the two data signals are the same. However, whereas the first data signal comprises a negative pulse followed by a positive pulse and forms a "switching" data signal, the second "non-witching" data signal comprises a positive pulse followed by a negative pulse. Such an addressing scheme is suitable for use with monochrome or black and white displays, although different analogue grey levels could be addressed by varying the amplitude of the data signals.

Figure 4:
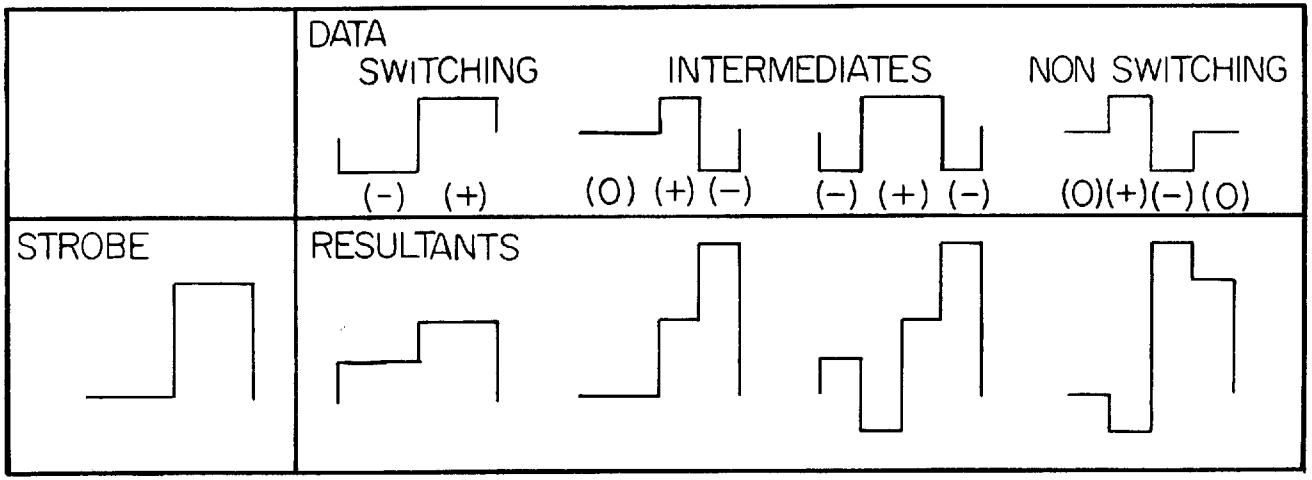
FIG. 4 illustrates strobe and data signals of a known grey level addressing scheme.

FIG. 4 illustrates another known addressing scheme having four data signals so as to permit two intermediate grey levels to be addressed. The data signals have no net direct component but, in this case, have different RMS voltages. Further, the polarity behaviour with respect to time varies for the different data signals. Thus, the "switching" data signal comprises a negative pulse followed by a positive pulse whereas the non-switching data signal and one of the intermediate data signals comprises a shorter positive pulse followed by a shorter negative pulse. The other intermediate signal comprises a short negative pulse followed by a longer positive pulse followed by a short negative pulse.

Figure 5:
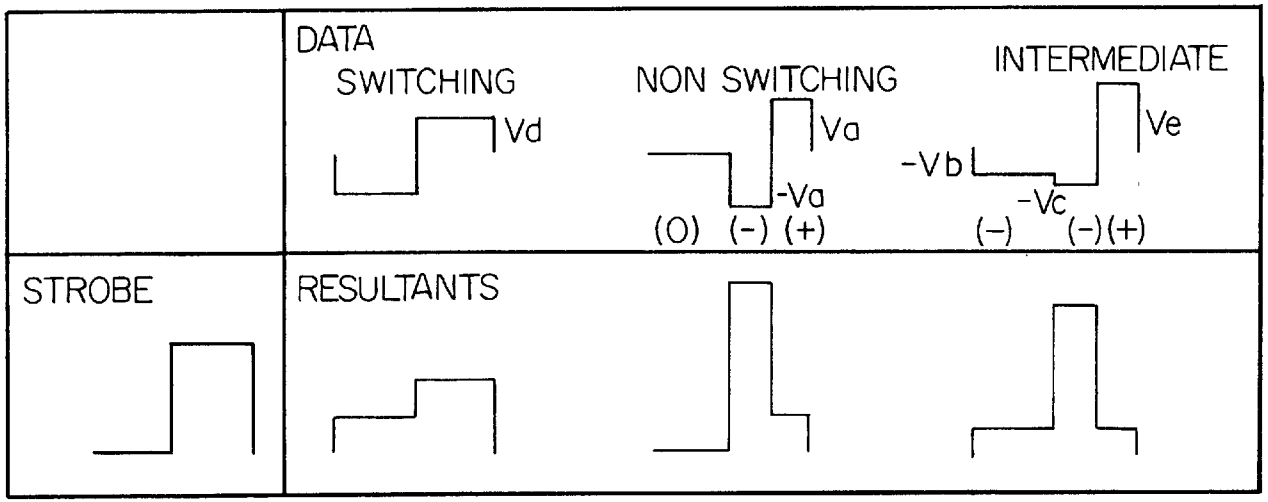
FIGS. 5 and 6 illustrate strobe and data signals of an addressing scheme constituting an embodiment of the invention.

FIG. 5 illustrates the data signals of an addressing scheme constituting an embodiment of the invention. A switching data signal, a non-switching data signal, and one intermediate data signal are illustrated so as to permit one intermediate grey level to be addressed. The data signals meet three requirements, which are: (i) each data signal has no net DC component; (ii) the data signals have the same RMS voltage; and (iii) the data signals have the same polarity behaviour with time. The switching data signal comprises a negative pulse of amplitude Vd occupying two time sub-slots, followed by a positive pulse of amplitude Vd occupying two time sub-slots. The non-switching data signal is zero for two sub-slots, minus Va for one sub-slot, and +Va for the final sub-slot. The intermediate data signal is at −Vb for two sub-slots, −Vc for one sub-slot, and +Ve for one sub-slot. Thus, each of the data signals comprises a negative portion followed by a positive portion i.e. all of the data signals exhibit the same polarity behaviour with respect to time. Although only one intermediate data signal waveform is shown, there is theoretically an Infinite number of waveforms which meet the above three requirements and which are suitable for use as intermediate data signals.

In order for the data signals to have the same RMS voltage, the various pulse amplitudes mentioned above fulfil the following conditions:

$$Va=(\sqrt{2})Vd$$

$$Vb=Vd/2$$

$$Vc=((\sqrt{6})-1)Vd/2$$

$$Ve=((\sqrt{6})+1)Vd/2$$

The switching data signal shown in FIG. 5 corresponds to the switching data signal of the known JOERS/Alvey addressing scheme.

Figure 6:
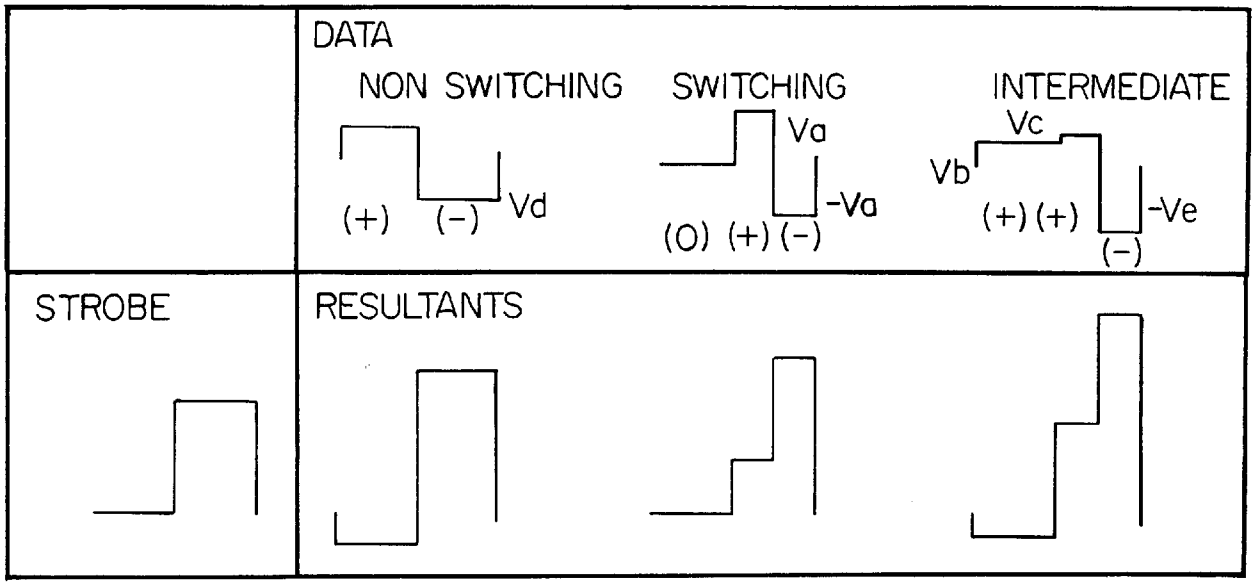

FIG. 6 illustrates another addressing scheme constituting a preferred embodiment of the invention. In this scheme, the data signal waveforms are inverted with respect to those shown in FIG. 5. Thus, the data signals exhibit the same polarity behaviour with respect to time but, in this case, each data signal comprises a positive portion followed by a negative portion. The non-switching data signal corresponds to that of the known JOERS/Alvey addressing scheme.

Figure 8:
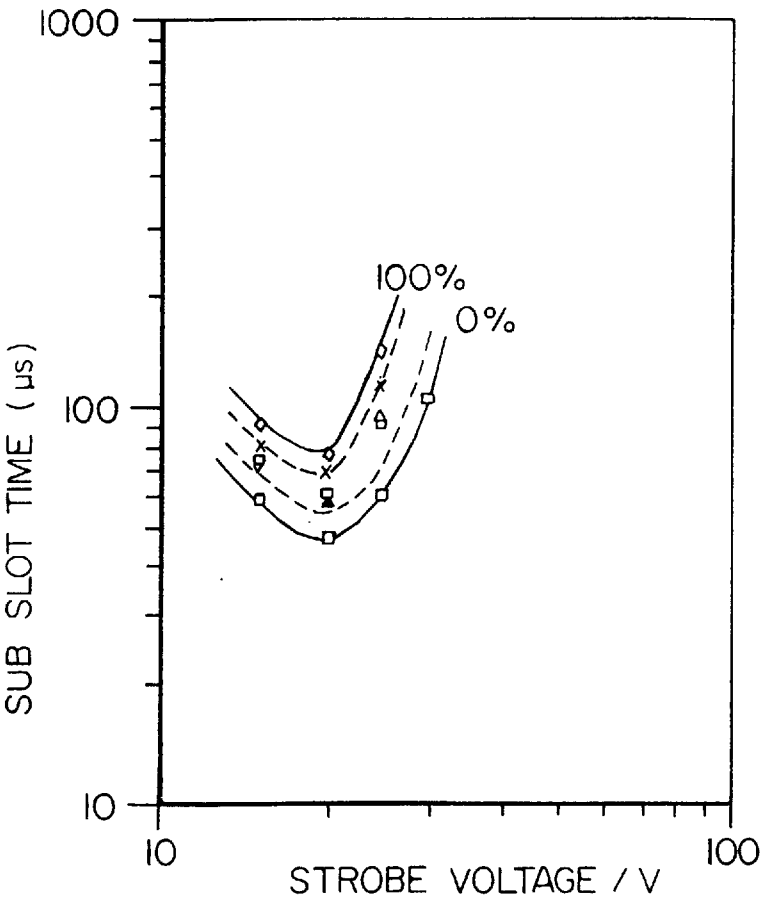
FIGS. 7 to 12 are graphs showing $\tau$-V characteristics which may be obtained using the addressing schemes illustrated in FIGS. 3 and 5.
Figure 7:
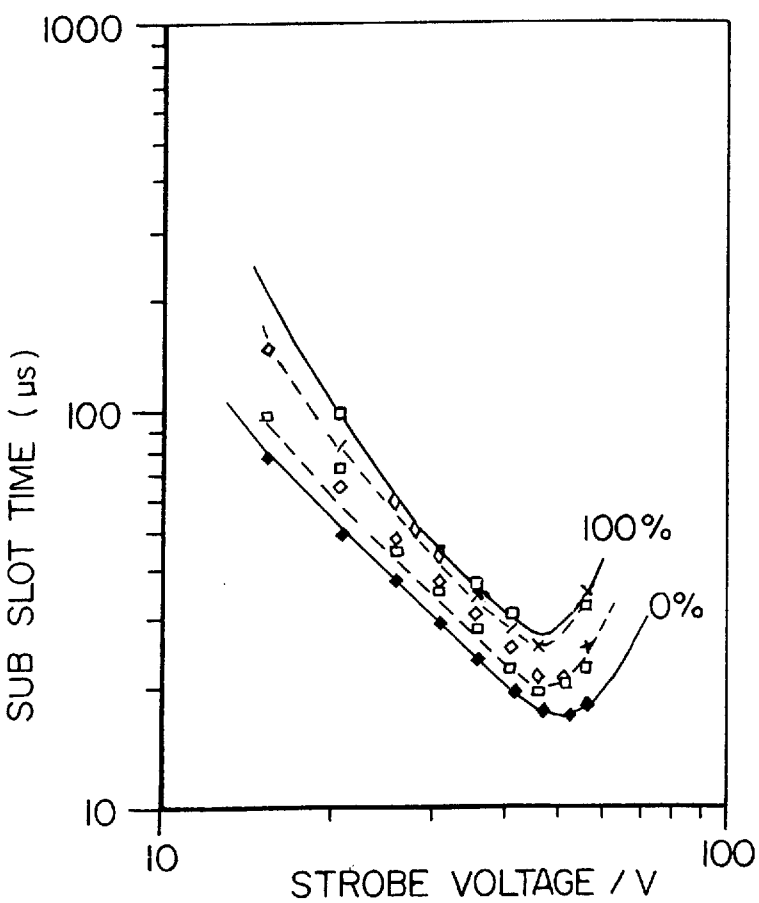

FIGS. 7 and 8 show τ-V characteristics of a display of the type illustrated in FIG. 1 for black and white operation using data signals of the known JOERS/Alvey type as illustrated in FIG. 3. The broken lines show the τ-V characteristics without the effects of pixel patterning (basic switch width) whereas the full lines show the effects of pixel patterning before and after a strobe signal. FIG. 7 relates to switching data signals whereas FIG. 8 relates to non-switching data signals. The τ-V characteristics are substantially affected by pixel patterning.

Figure 10:
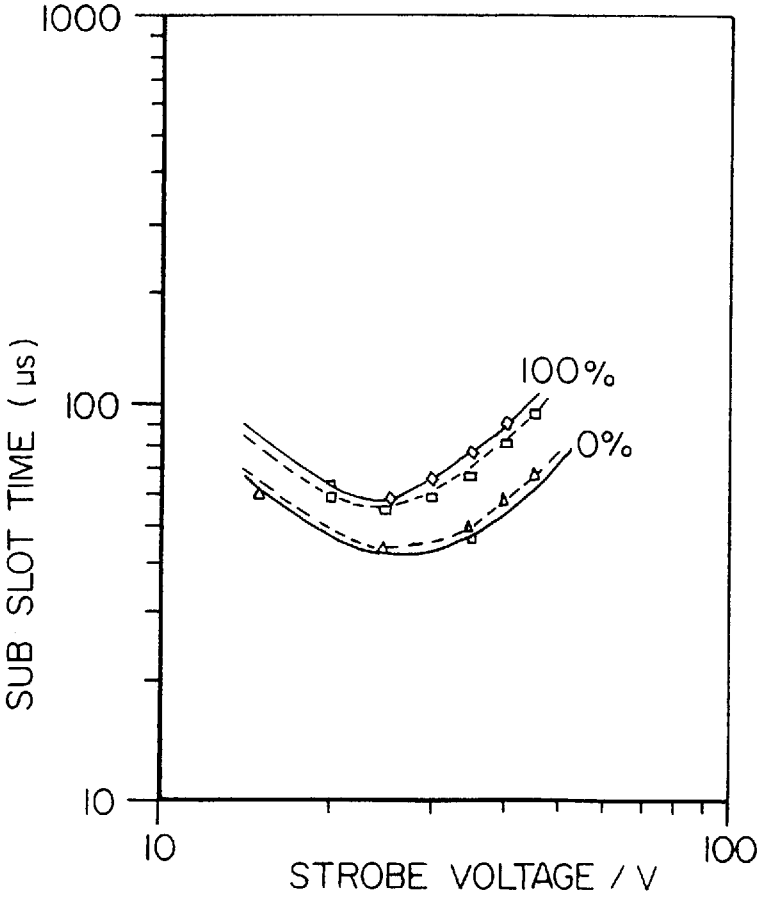
Figure 9:
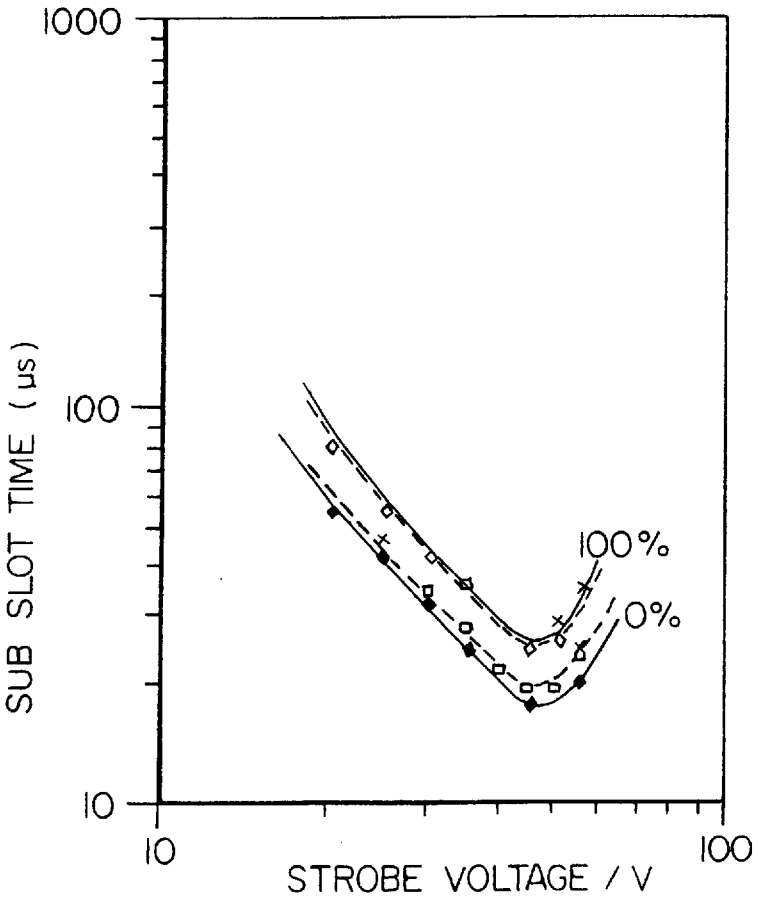

FIGS. 9 and 10 show switch and non-switch curves using the addressing scheme illustrated in FIG. 5. The effects of pixel patterning are greatly reduced by using data signals having the same polarity behaviour with respect to time.

Figure 12:
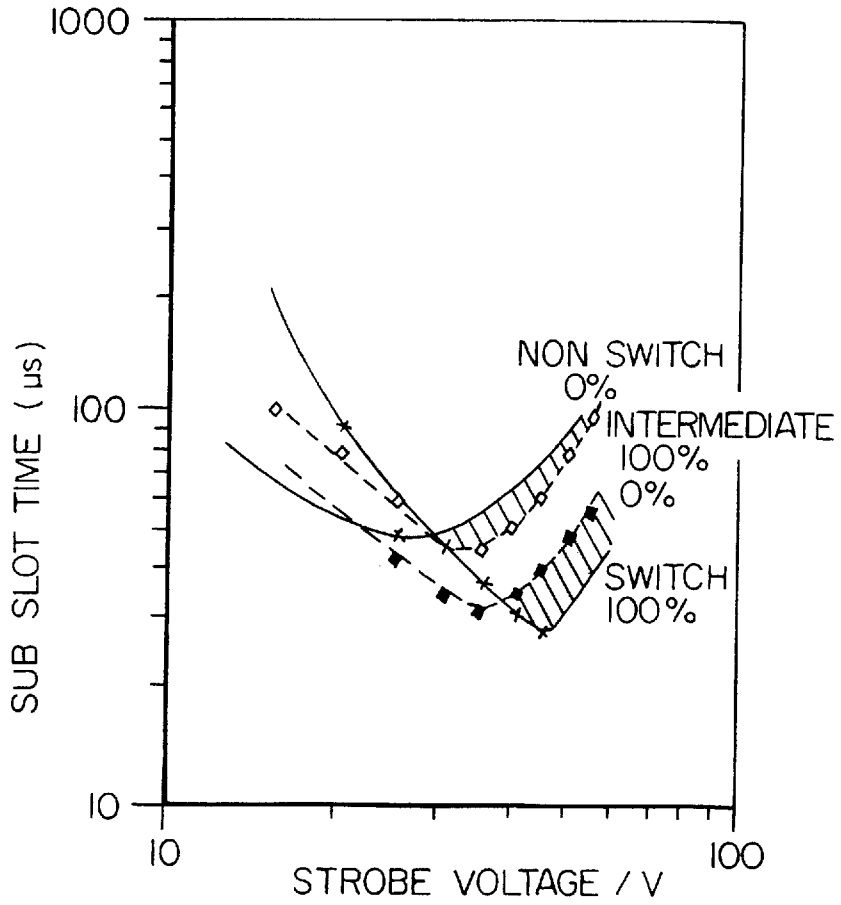
Figure 11:
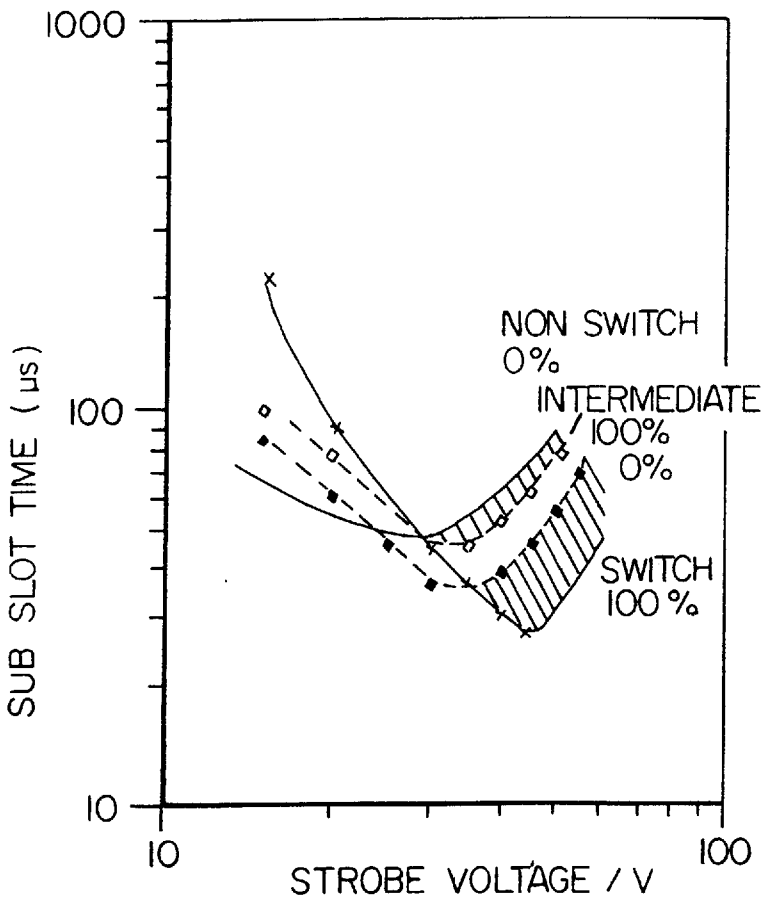

FIGS. 11 and 12 illustrate the use of the data signals of FIG. 5 on one threshold level of a MT display of the type shown in FIG. 1 and providing an intermediate grey level. FIG. 11 illustrates performance in the absence of pixel patterning whereas FIG. 12 illustrates performance with pixel patterning. The shaded regions illustrate the "driving windows" for the display. As is apparent by comparing FIGS. 11 and 12, using the addressing scheme Illustrated in FIG. 5, the effects of pixel patterning do not compromise the addressing of the pixels. Only the switch width for the intermediate data signal is significantly affected by pixel patterning but a reasonable drive window remains so that the three grey levels of each pixel can be reliably addressed.

Figure 13:
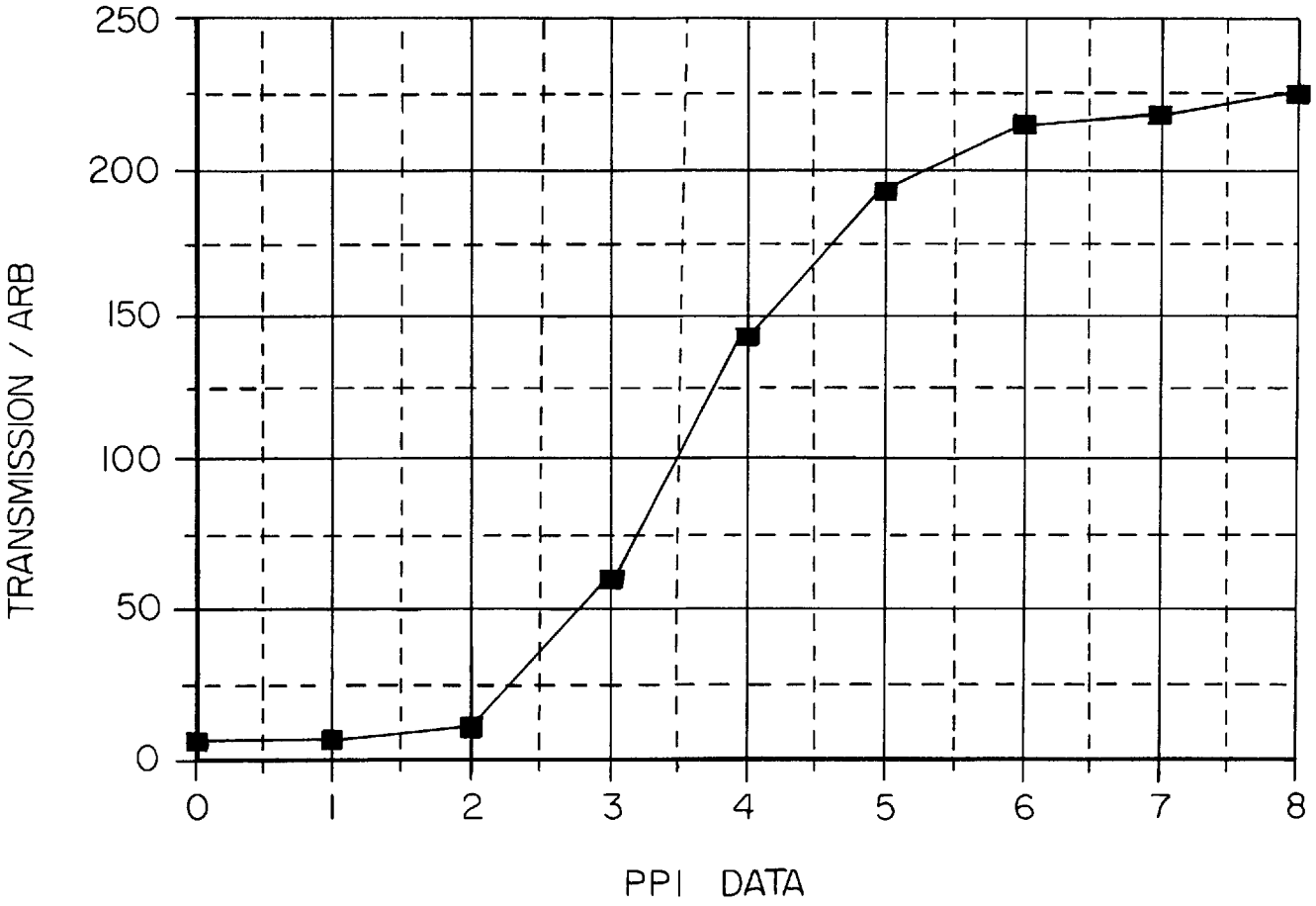
FIG. 13 is a graph of the transmission as a function of Pixel Pattern Independent data of a cell which produces analogue grey levels.

The above described methods in accordance with the present invention are also of benefit when addressing cells capable of producing analogue grey levels. Such cells have switching curves similar to those shown in FIGS. 7 to 10. However, instead of using discrete switching regions outside the 0% to 100% switch range, the substantially continuous thresholds between the 0% and 100% switch limits are used. This region may be used to produce analogue grey levels. Such grey levels are dependent upon pixel pattern and so a reduced pixel pattern addressing scheme is advantageous. For example, a cell comprising SCE8 has the above described region of continuous thresholds between the 0% and 100% switch limits, as shown in FIG. 13. In FIG. 13, a Malvern 2 type strobe pulse of 36V has been used with a 20 μs time slot and a data pulse of 8V (RMS). The Pixel Pattern Independent (PPI) data shapes used are of the type shown in FIG. 5. These are voltages and shapes which reduce pixel patterning. The PPI data axis relates to the voltage of the first two data slots. The final two data slots can be fixed by the rules described above in relation to the present invention, i.e. each data signal has no net DC component, the data signals have the same RMS voltage and the data signals have the same polarity behaviour with time.

It is thus possible to reduce the pixel pattern dependence of drive schemes, both for black and white displays and for displays capable of intermediate grey levels. This represents a significant advance in the use of FLCDs for large direct view high resolution display application and such addressing schemes may be necessary for fast addressing of analogue intermediate grey levels.

What is claimed is:

1. A bistable liquid crystal display comprising: a plurality of data electrodes; a plurality of strobe electrodes; a plurality of liquid crystal pixels formed at intersections between the data electrodes and the strobe electrodes; a strobe signal generator arranged to supply strobe signals sequentially to the strobe electrodes; and a data signal generator arranged to supply any selected one of a plurality of different data signals to each of the data electrodes in synchronism with the strobe signals, wherein the data signals have the same polarity behaviour with respect to time.

2. A display as claimed in claim 1, wherein the data signals have the same RMS voltage.

3. A display as claimed in claim 1, wherein each of the different data signals has no net DC component.

4. A display as claimed in claim 1, wherein each pixel has X discrete switching thresholds, where K is an integer greater than or equal to two, and the plurality of different data signals comprises at least (X+1) different data signals.

5. A display as claimed in claim 1, in which each pixel has a substantially continuous range of thresholds and the plurality of different data signals comprises at least Y different data signals for addressing Y discrete switching thresholds from the continuous range, where Y is an integer greater than or equal to two.

6. A display as claimed in claim 1, wherein the liquid crystal is a smectic liquid crystal.

7. A display as claimed in claim 1, wherein the liquid crystal is a ferroelectric liquid crystal.

8. A display as claimed in claim 1, wherein the liquid crystal has a minimum in its response time-voltage ($\tau$-V) characteristic.

9. A display as claimed in claim 1, wherein each of the different data signals comprises a rectangular waveform.

10. A data signal generator for a liquid crystal display of the type comprising: a plurality of data electrodes; a plurality of strobe electrodes; and a plurality of liquid crystal pixels formed at intersections between the data electrodes and the strobe electrodes, wherein the data signal generator is arranged to produce any selected one of a plurality of different data signals having the same polarity behaviour with respect to time.

11. A generator as claimed in claim 10, wherein the data signals have the same RMS voltage.

12. A generator as claimed in claim 10, wherein each of the different data signals has no net DC component.

13. A generator as claimed in claim 10, wherein each of the different data signals comprises a rectangular waveform.

14. A method of addressing a liquid crystal display of the type comprising: a plurality of data electrodes; a plurality of strobe electrodes; and a plurality of liquid crystal pixels formed at intersections between the data electrodes and the strobe electrodes, the method comprising supplying strobe signals sequentially to the strobe electrodes and supplying any selected one of a plurality of different data signals to each of the data electrodes in synchronism with the strobe signals, the data signals having the same polarity behaviour with respect to time.

* * * * *